US008313290B2

(12) United States Patent
Tanaka et al.

(10) Patent No.: US 8,313,290 B2
(45) Date of Patent: Nov. 20, 2012

(54) CENTRIFUGAL COMPRESSOR HAVING VANELESS DIFFUSER AND VANELESS DIFFUSER THEREOF

(75) Inventors: Masanori Tanaka, Tokyo (JP); Hideo Nishida, Tokyo (JP); Hiromi Kobayashi, Tokyo (JP); Tetsuya Kuwano, Tokyo (JP); Toshio Itou, Tokyo (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 741 days.

(21) Appl. No.: 12/488,910

(22) Filed: Jun. 22, 2009

(65) Prior Publication Data

US 2009/0317248 A1 Dec. 24, 2009

(30) Foreign Application Priority Data

Jun. 23, 2008 (JP) ..... 2008-162882

(51) Int. Cl.
*F04D 29/44* (2006.01)

(52) U.S. Cl. ..... 415/199.1; 415/208.3; 415/208.4

(58) Field of Classification Search ..... 415/199.1, 415/199.2, 199.3, 208.3, 208.4, 208.5
See application file for complete search history.

(56) References Cited

U.S. PATENT DOCUMENTS 3,289,921 A * 12/1966 Soo ..... 415/207
6,203,275 B1 * 3/2001 Kobayashi et al. ..... 415/199.2

FOREIGN PATENT DOCUMENTS

| | | | |
|---|---|---|---|
| EP | 0 402 870 | A1 | 12/1980 |
| EP | 0 886 070 | A1 | 12/1998 |
| JP | 54-161007 | U | 11/1979 |
| JP | 1-173426 | U | 12/1989 |
| WO | WO 97/33092 | A1 | 9/1997 |

OTHER PUBLICATIONS

European Search Report dated Jan. 31, 2011 (Nine (9) pages).

* cited by examiner

*Primary Examiner* — Dwayne J White
(74) *Attorney, Agent, or Firm* — Crowell & Moring LLP

(57) ABSTRACT

In a high pressure centrifugal compressor, the occurrence of rotating stall noticeable in a comparatively-low specific speed wheel stage is prevented, thereby high efficient fluid performance is obtained and reliability is improved. The centrifugal compressor has a first vaneless diffuser with a constant flow channel height on the downstream side of an impeller, and a second vaneless diffuser in which the flow channel height decreases in a flow direction from an inlet to an outlet on the downstream side of the first vaneless diffuser. These diffusers are combined with an impeller using thick blades.

7 Claims, 9 Drawing Sheets

CENTRIFUGAL COMPRESSOR HAVING VANELESS DIFFUSER AND VANELESS DIFFUSER THEREOF

The present application claims priority from Japanese application JP2008-162882 filed on Jun. 23, 2008, the content of which is hereby incorporated by reference into this application.

BACKGROUND OF THE INVENTION

The present invention relates to a centrifugal compressor and a diffuser used therein, and more particularly, to a centrifugal compressor and a centrifugal blower to handle comparatively low flow rate gas, and a diffuser used therein.

In a high-pressure centrifugal compressor to handle high pressure gas, phenomena disturbing safe operation of the compressor such as noise, damage to an impeller, and vibration of shafting easily occur in comparison with a general centrifugal compressor. One of the phenomena is rotating stall.

The rotating stall occurs mainly in a comparatively-low specific speed impeller stage. It is considered as the mechanism of the rotating stall that the rotating stall occurs due to a reverse flow which occurs in a flow in the diffuser. The flow in the diffuser is a deceleration flow, and separation of the flow from a wall surface easily occurs in accordance with inverse pressure gradient. This phenomenon easily occurs on the downstream side in accordance with increase in a ratio of a flow channel height of the diffuser to an outlet radius of an impeller. It is considered that the separation of the flow gradually increases, which leads to the rotating stall.

In the centrifugal compressor in which the rotating stall may occur, a technique using a vaned diffuser is disclosed in International application WO97/33092. According to this technique, a vaned diffuser with a constant flow-channel height and a low solidity (a low chord-pitch ratio) is provided on the downstream side of the impeller, and on its downstream side, a vaneless diffuser in which the flow channel height decreases in a flow direction is provided. In this structure, the efficiency of the compressor is improved while the rotating stall is prevented.

However, in the technique using the vaned diffuser as disclosed in the above-described International application WO97/33092, usage in a high-pressure centrifugal compressor is not sufficiently considered.

That is, in some cases, a comparatively-low specific speed (specific speed: about 200 and/or lower) impeller using wedge-shaped thick impeller blades is employed in a high-pressure comparatively-low specific speed centrifugal compressor. In a comparatively-low specific speed region, the performance of the thick blade impeller is greater than that of a general thin blade impeller. However, in the thick blade impeller, as the impeller height is higher in comparison with a thin blade impeller with the same flow rate, a radial component of the speed at a diffuser inlet is small. Accordingly, a flow angle is small. Further, by a wake flow from a trailing edge of the thick blade impeller, a flow at a small flow angle locally occurs in circumferential speed distribution at the impeller outlet. Accordingly, a reverse flow in the diffuser easily occurs in comparison with a thin blade impeller stage with the same flow rate. In this manner, in the conventional high pressure centrifugal compressor, prevention of rotating stall is not considered.

BRIEF SUMMARY OF THE INVENTION

The object of the present invention is, in a centrifugal compressor having an inlet flow channel, an impeller, a vaneless diffuser, and a return channel, to prevent rotating stall which noticeably occurs in a comparatively-low specific speed impeller stage, and to provide a high-performance and high-reliability high pressure centrifugal compressor.

A centrifugal compressor according to the present invention comprises: a rotating shaft, an impeller attached to the rotating shaft; a vaneless diffuser provided on the downstream side of the impeller; an inlet flow channel; and a return channel. The vaneless diffuser has a first vaneless diffuser with a constant flow channel height provided on the downstream side of the impeller, and a second vaneless diffuser in which a flow channel height decreases in a flow direction from an inlet to an outlet, provided on the downstream side of the first vaneless diffuser.

Further, in the second vaneless diffuser, an inlet radius ratio $r_m/r_{imp}$ as a ratio between an inlet radius $r_m$ of the second vaneless diffuser and an outlet radius $r_{imp}$ of the impeller becomes smaller in accordance with decrease in a flow channel height ratio $b_m/r_{imp}$ as a ratio between an inlet flow channel height $b_m$ of the second vaneless diffuser and the outlet radius $r_{imp}$ of the impeller.

Further, an outlet flow channel height $b_o$ of the second vaneless diffuser is set to 0.4 to 0.6 times of the inlet flow channel height $b_m$ of the second vaneless diffuser. Further, the inlet radius ratio $r_m/r_{imp}$ of the second vaneless diffuser is given as a function ($r_m/r_{imp} \leqq 1.03+3.0 \cdot b_m/r_{imp}$) of the flow channel height ratio $b_m/r_{imp}$ of the second vaneless diffuser.

Further, the flow channel height ratio $b_m/r_{imp}$ of the second vaneless diffuser is equal to or less than 0.1. Further, a longitudinal cross-sectional wall surface shape of the first and second vaneless diffusers consists of straight lines. Further, a wall surface shape in the longitudinal cross-sectional shape of the first and second vaneless diffusers includes a curve. Further, the centrifugal compressor further comprises an impeller having a wedge-shaped thick blades./in a centrifugal compressor comprising: an inlet flow channel; an impeller; a vaneless diffuser: and a return channel, the impeller has wedge-shaped thick blades.

Further, a vaneless diffuser according to the present invention comprises: a first vaneless diffuser with a constant flow channel height; and a second vaneless diffuser, in which a flow channel height decreases in a flow direction from an inlet to an outlet, provided on the downstream side of the first vaneless diffuser.

In the high pressure centrifugal compressor according to the present invention, the occurrence of rotating stall can be prevented with the vaneless diffuser. Further, the efficiency is higher in comparison with a vaneless diffuser in which the flow channel height in the diffuser gradually decreases from a diffuser inlet in a downstream direction. Further, by combining the diffuser with a impeller stage using thick blades, the efficiency can be improved while the occurrence of rotating stall is prevented.

DETAILED DESCRIPTION OF THE INVENTION

Hereinbelow, embodiments of the present invention will be described in detail using the accompanying drawings.

First Embodiment

Figure 1:
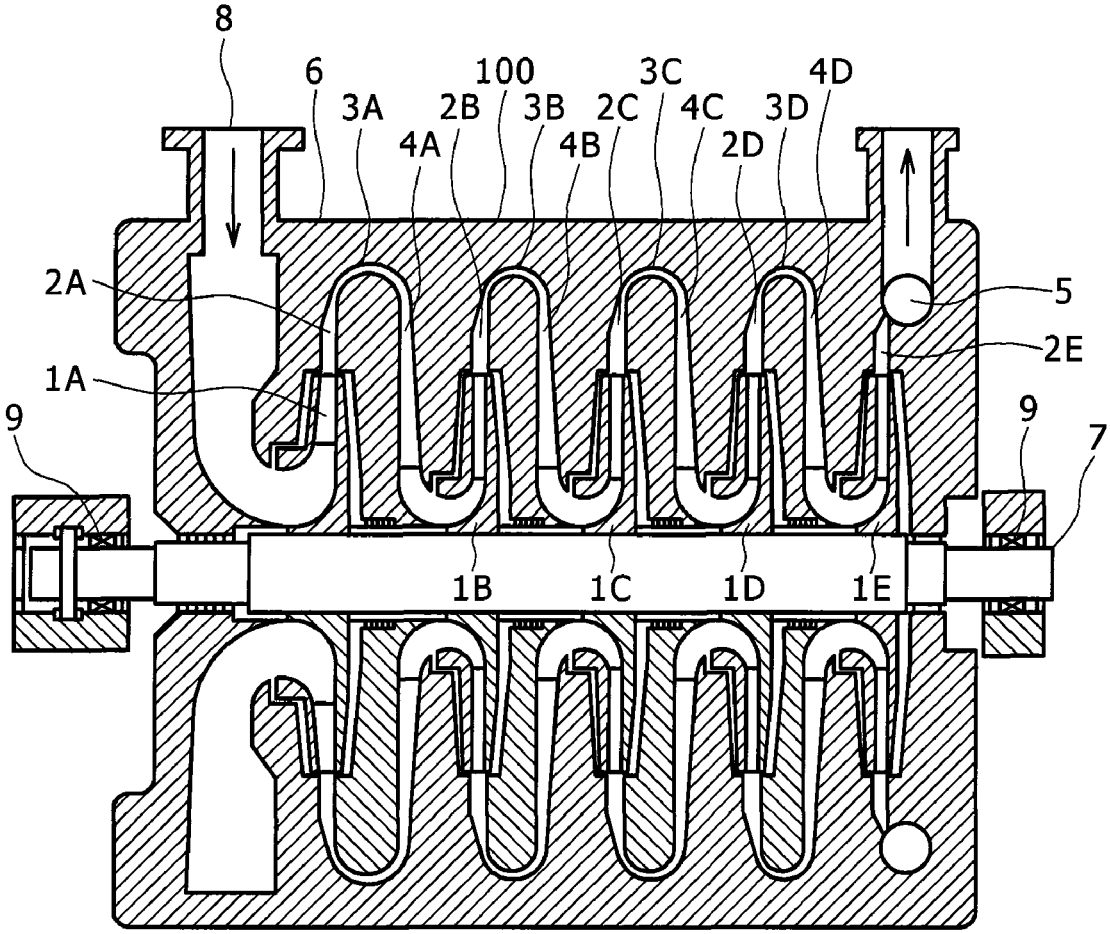
FIG. 1 is a longitudinal cross-sectional view of a multi-stage centrifugal compressor according to a first embodiment of the present invention.

FIG. 1 shows a longitudinal cross-sectional shape of a single-shaft multi-stage centrifugal compressor according to a first embodiment of the present invention. A compressor stage having plural impellers 1A to 1E, diffusers 2A to 2E, return bends (return channels) 3A to 3D, and guide blades 4A to 4D, is arranged in an axial direction, thereby a single-shaft multi-stage centrifugal compressor 100 is formed. The plural impellers 1A to 1E stacked in the axial direction are attached to a rotating shaft 7, and both ends of the rotating shaft 7 are rotatably supported with bearings 9.

The diffusers 2A to 2E are provided on the outer side in the radial direction as a downstream side of the respective impellers 1A to 1E. The diffusers 2A to 2D in the respective stages except the final stage are connected to the return bends 3A to 3D to guide working fluid to the next stage, and the guide blades 4A to 4D to guide the working fluid inwardly in the radial direction are formed on the downstream side of the return bends 3A to 3D. A scroll 5 to collect the working fluid discharged from the impeller in the final stage and discharge the working fluid from a discharge pipe (not shown) is formed on the downstream side of the diffuser 2E in the final stage.

The diffusers 2A to 2E, the return bends 3A to 3D, the guide blades 4A to 4D and the scroll 5 are stationary members, and are formed in a compressor casing 6. The working fluid sucked from an inlet 8 is pressure-increased with the impeller 1A and the diffuser 2A in the first stage, then the flow direction of the working fluid is changed from radial outward direction to radial inward direction with the return bend 3A and the guide blade 4A, and is guided to the impeller in the second stage. Hereinbelow, this flow is repeated in the respective stages, thereby the fluid is sequentially pressure-increased, then through the diffuser in the final stage, then passed through the discharge scroll 5 and is guided to the discharge pipe.

Figure 2:
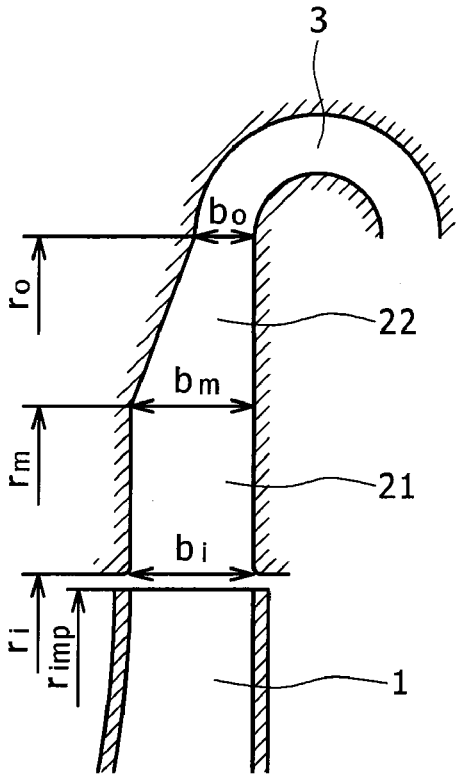
FIG. 2 is an enlarged cross-sectional view of a diffuser part of the multi-stage centrifugal compressor in FIG. 1.

FIG. 2 shows an enlarged cross-sectional shape of one diffuser of the single-shaft multi-stage centrifugal compressor in FIG. 1. The diffuser has a first vaneless diffuser 21 with a constant flow channel height provided downstream from the impeller 1, and a second vaneless diffuser 22, in which the flow channel height decreases in the flow direction, provided downstream from the first vaneless diffuser 21. The return bend 3 to guide the working fluid to the next stage is provided downstream from the second vaneless diffuser 22.

In the first vaneless diffuser 21, an inlet flow channel height $b_1$ and an outlet flow channel height $b_m$ are the same. The outlet of the first vaneless diffuser 21 is also used as an inlet of the second vaneless diffuser 22. In the second vaneless diffuser 22, an outlet flow channel height $b_o$ is lower than the inlet flow channel height $b_m$, and the flow channel height in the second vaneless diffuser 22 becomes lower toward the downstream side. By using this diffuser, the occurrence of rotating stall particularly noticeable in a comparatively-low specific speed stage can be prevented. This is achieved for the following reasons.

Figure 3:
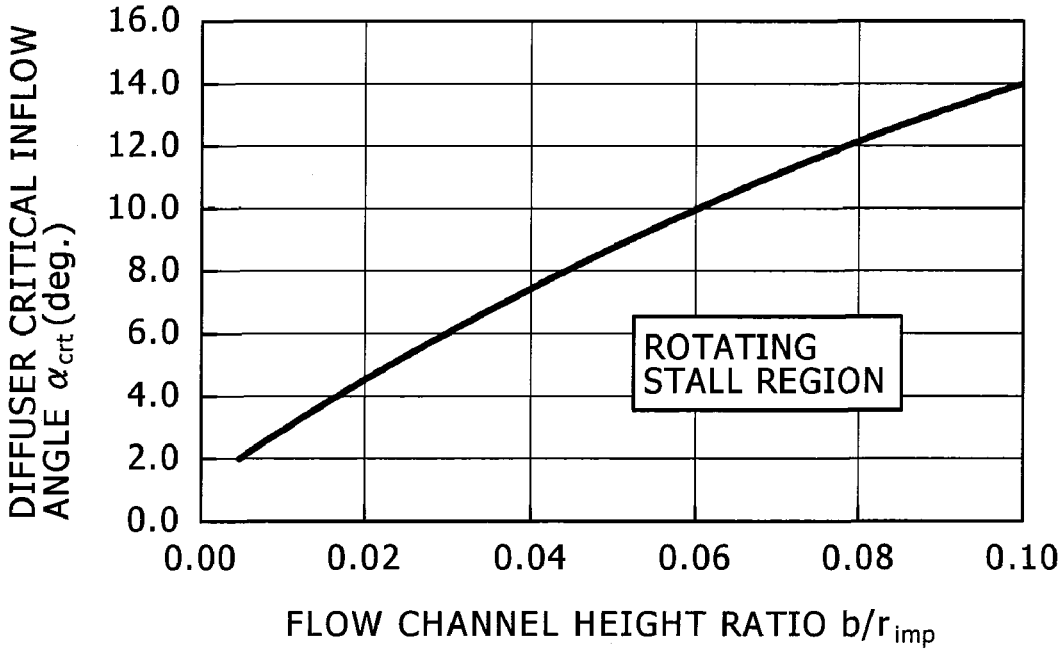
FIG. 3 is a graph showing a characteristic of a critical inflow angle of a flow in a parallel wall vaneless diffuser.
Figure 4:
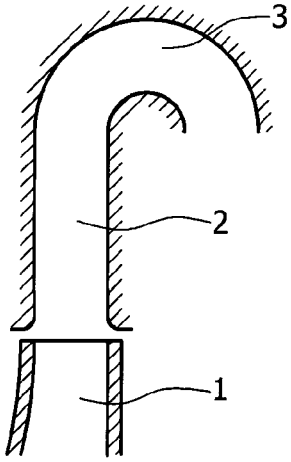
FIG. 4 is a cross-sectional view of the parallel wall vaneless diffuser.

FIG. 3 shows a characteristic of a critical inflow angle $\alpha_{crt}$ of a flow in a parallel wall vaneless diffuser shown in FIG. 4. The inflow angle $\alpha$ is defined as an angle $\alpha$ at which the flow direction at the diffuser inlet (impeller outlet) is a tangent line direction. The lateral axis indicates a ratio $b/r_{imp}$ between the flow channel height b of the diffuser and the outlet radius $r_{imp}$ of the impeller, and the vertical axis, the diffuser critical inflow angle $\alpha_{crt}$ as the limitation of occurrence of rotating stall. The characteristic diagram indicates that the diffuser critical inflow angle $\alpha_{crt}$ becomes wider in accordance with increase in the diffuser flow channel height ratio $b/r_{imp}$. In a diffuser with a flow channel height ratio $b/r_{imp}$, when the inflow angle $\alpha$ is smaller than the critical inflow angle $\alpha_{crt}$ shown in the figure, the rotating stall occurs.

According to the above description, it is understood that the rotating stall can be prevented by increasing the inflow angle to the diffuser. For this purpose, it may be arranged such that the diffuser inlet flow channel height is low and the longitudinal cross-sectional speed of the flow is high. However, the decrease in the diffuser inlet flow channel height on the immediately downstream side of the impeller outlet might increase frictional loss in the diffuser part and reduce the efficiency of the compressor.

In the present embodiment, the first vaneless diffuser having a constant flow channel height is provided on the downstream side of the impeller, and the second vaneless diffuser where the flow channel height gradually decreases in the flow direction from the inlet to the outlet is provided on the downstream side of the first vaneless diffuser. As the first vaneless diffuser with the constant flow channel height is a diffuser first half part on the immediately downstream side of the impeller, increase in the frictional loss can be prevented. Further, as the second vaneless diffuser where the flow channel height gradually decreases in the flow direction from the inlet to the outlet is a diffuser last half part, the flow angle is wide. Accordingly, development of boundary layer on wall surface is suppressed, and the flow is stabled. Thus reverse of the flow can be prevented, and the occurrence of rotating stall can be prevented.

Second Embodiment

Figure 5:
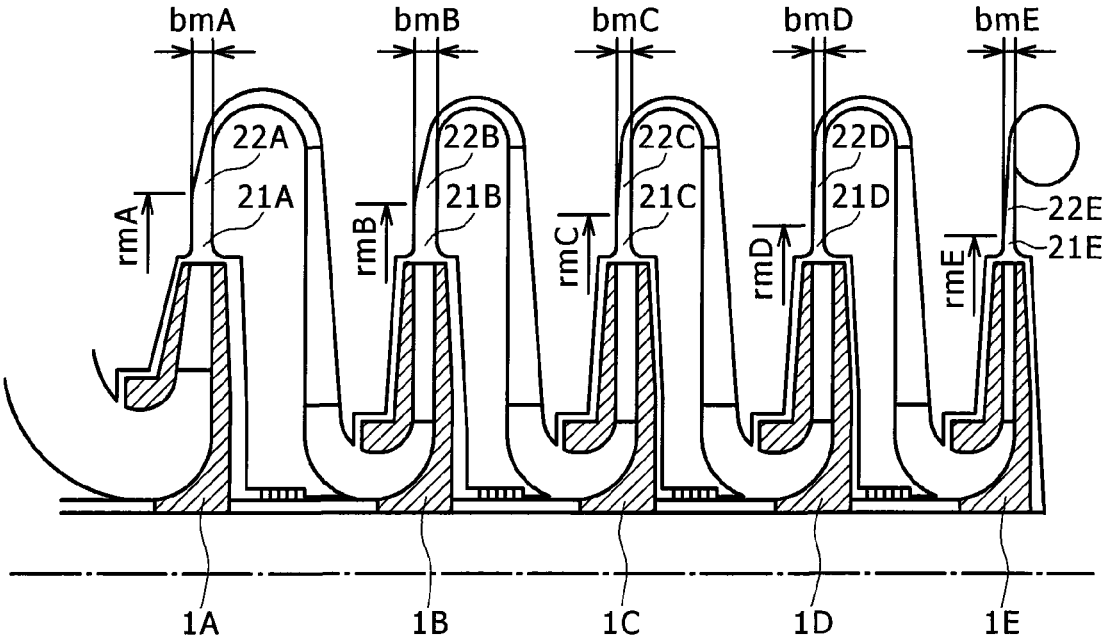
FIG. 5 is a longitudinal cross-sectional view of the multi-stage centrifugal compressor according to a second embodiment of the present invention.

FIG. 5 shows a second embodiment and shows a longitudinal cross-sectional shape of the single-shaft multi-stage centrifugal compressor. The diffuser of the centrifugal compressor has first vaneless diffusers 21A to 21E with a constant flow channel height and second vaneless diffusers 22A to 22E, in which the flow channel height decreases in the flow direction, provided downstream from the first vaneless diffusers.

In this centrifugal compressor, the outlet height of the impeller becomes lower in the downstream stages since the volume flow rate becomes smaller in the lower stage. Accordingly, the inlet flow channel heights $b_m$A to $b_m$E of the second vaneless diffusers 22A to 22E, in which the flow channel height gradually decreases in the flow direction from the inlet to the outlet in the respective stages, become lower in the downstream stages. The radial positions $r_m$A to $r_m$E of the inlets of the second vaneless diffusers are smaller in the downstream stages. That is, an inlet radius ratio $r_m/r_{imp}$ as a ratio between an inlet radius $r_m$ of the second vaneless diffuser and the outlet radius $r_{imp}$ of the impeller becomes smaller in accordance with decrease in a flow channel height ratio $b_m/r_{imp}$ as a ratio between the inlet flow channel height $b_m$ of the second vaneless diffuser and the outlet radius $r_{imp}$ of the impeller.

Figure 6:
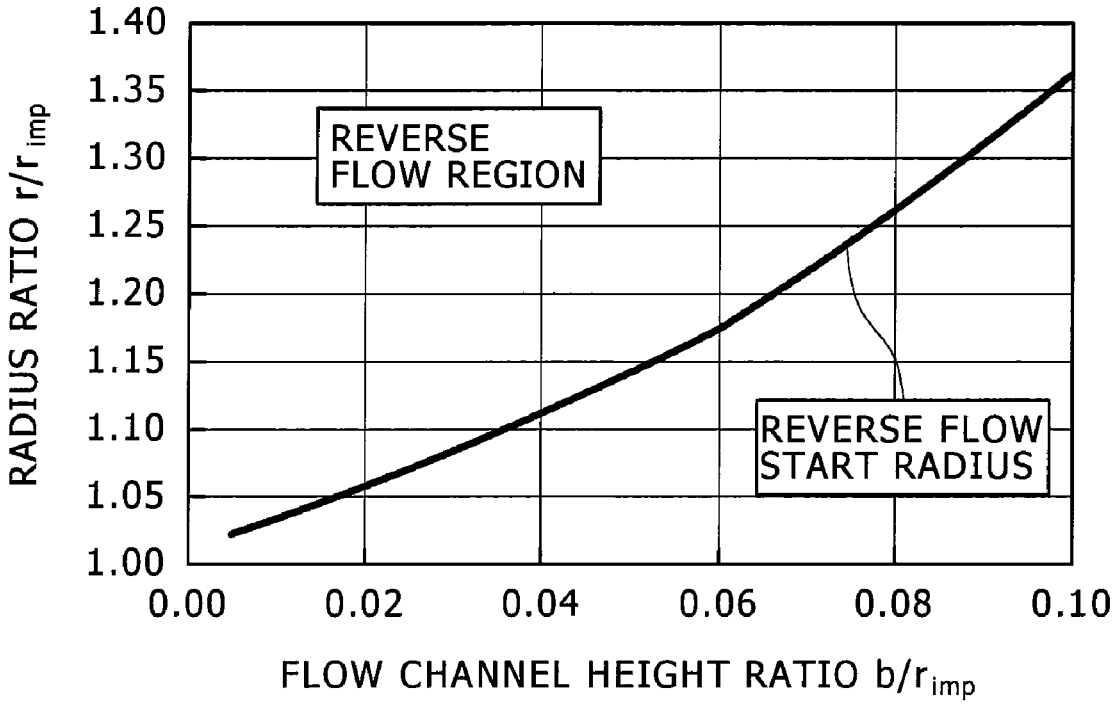
FIG. 6 is a graph showing the relation between a flow channel height ratio and a radius ratio in a position where a reverse flow occurs.

It is understood from FIG. 6 that a radial position $r/r_{imp}$ in which reverse flow occurs becomes smaller in accordance with decrease in the flow channel height ratio $b/r_{imp}$. Accordingly, as the flow channel height ratio $b/r_{imp}$ is smaller, the inlet radius ratio $r/r_{imp}$ is smaller. For example, when the inlet radial position $r_m$ of the second vaneless diffuser in which the flow channel height decreases in the flow direction is reduced in accordance with decrease in the flow channel height ratio $b/r_{imp}$, so as to increase the flow angle and prevent the occurrence of reverse flow, the occurrence of rotating stall can be prevented.

Further, FIG. 6 shows limitation of occurrence of reverse flow in the parallel wall vaneless diffuser shown in FIG. 4. The lateral axis indicates the flow channel height ratio $b/r_{imp}$ of the diffuser, and the vertical axis, the ratio $r/r_{imp}$ between the radial position r in which a reverse flow occurs in the diffuser and the outlet radius $r_{imp}$ of the impeller. FIG. 6 shows that the minimum radial position r in which a reverse flow occurs becomes smaller in accordance with decrease in the flow channel height ratio $b/r_{imp}$ of the diffuser. It is considered that the rotating stall in the vaneless diffuser occurs due to development of the reverse flow.

Third Embodiment

As a third embodiment, a diffuser drawing ratio is logically calculated from the result of measurement of the flow angle in the parallel wall vaneless diffuser, and based on the experimental measurement, the outlet flow channel height $b_o$ of the second vaneless diffuser in FIG. 2 is set to 0.4 to 0.6 times of the inlet flow channel height $b_m$ of the second vaneless diffuser. When the value of $b_o/b_m$ is too large, the effect of decrease in the flow channel height is reduced, while when the value of $b_o/b_m$ is too small, the flow velocity is too high and the frictional loss is increased.

Fourth Embodiment

As a fourth embodiment, in FIG. 5, the inlet radius ratio $r_m/r_{imp}$ of the second vaneless diffuser is given as a function of the flow channel height ratio $b_m/r_{imp}$ of the second vaneless diffuser in the following expression (1).

$$r_m/r_{imp} \leq 1.03+3.0 \cdot b_m/r_{imp} \quad (1)$$

The expression (1) is linear approximation of the relation between the flow channel height ratio $b/r_{imp}$ at which the rotating stall occurs and the radius ratio $r/r_{imp}$ in a position in which a reverse flow occurs as shown in FIG. 6. That is, when the flow channel height $b_m$ is determined, a position in which a reverse flow occurs is obtained. When the inlet radius position of the second vaneless diffuser is smaller than the radius position in which a reverse flow occurs, predicted by this expression, as the flow angle can be wider on the upstream side of the position in which the reverse flow occurs, the occurrence of rotating stall can be prevented. Further, when the inlet radius ratio $r_m/r_{imp}$ of the second vaneless diffuser is smaller than the value determined with the expression (1), as the flow angle can be wider on the upstream side of the position in which the reverse flow occurs, the occurrence of rotating stall can be prevented.

Fifth Embodiment

The characteristic feature of the fifth embodiment is that the flow channel height ratio $b_m/r_{imp}$ of the second vaneless diffuser in FIG. 6 is equal to or less than 0.1, because in a comparatively-low specific speed impeller stage in which the flow channel height ratio $b_m/r_{imp}$ is equal to or greater than 0.1, the occurrence of rotating stall is noticeable.

Sixth to Eighth Embodiment

Figure 7:
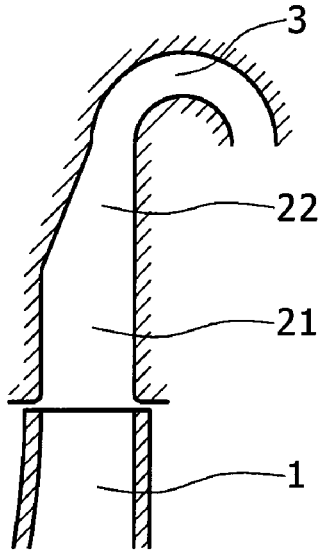
FIGS. 7 to 15 are cross-sectional views of the vaneless diffuser according to sixth to fourteenth embodiments of the present invention.
Figure 8:
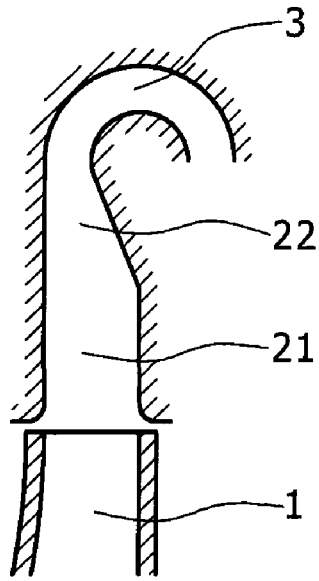
Figure 9:
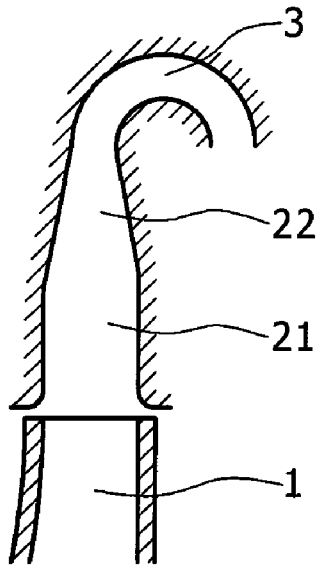
Figure 10:
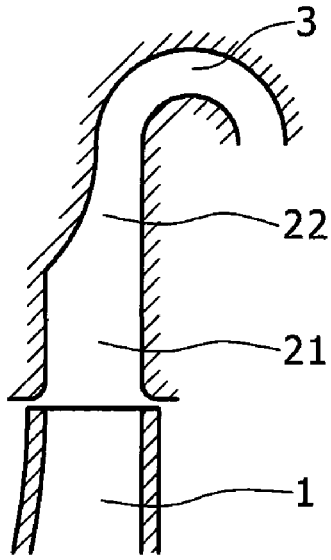

FIGS. 7 to 9 show sixth to eighth embodiments. In these embodiments, the longitudinal cross-sectional shape of the second vaneless diffuser in which the flow channel height decreases in the flow direction consists of straight lines. In the sixth embodiment shown in FIG. 7, the wall surface shape on the hub side (right side in the figure) of the second vaneless diffuser 22 is an extension of the first vaneless diffuser 21. The wall surface shape on the shroud side (left side in the figure) is inclined toward the hub side.

In the seventh embodiment shown in FIG. 8, opposite to the sixth embodiment in FIG. 7, the wall surface shape on the hub side (right side in the figure) is inclined toward the shroud side (left side in the figure). In the eighth embodiment shown in FIG. 9, the wall surface shapes on the hub side and the shroud side in the second vaneless diffuser are inclined toward each other.

Ninth to Fourteenth Embodiments

FIGS. 10 to 15 show ninth to fourteenth embodiments. In these embodiments, the longitudinal cross-sectional shape of the second vaneless diffuser in which the flow channel height decreases in the flow direction includes a curve. In the ninth embodiment shown in FIG. 10, the wall surface shape on the hub side (right side in the figure) of the second vaneless diffuser is an extension of the first vaneless diffuser. The wall surface shape on the shroud side is inclined toward the hub side. The shape includes a curve, and the outlet of the second vaneless diffuser is smoothly connected to the return bend inlet on the downstream side.

Figure 11:
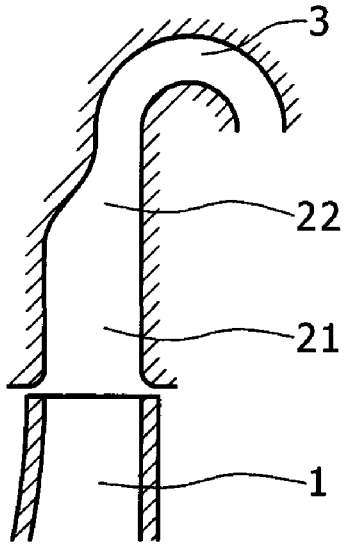
Figure 12:
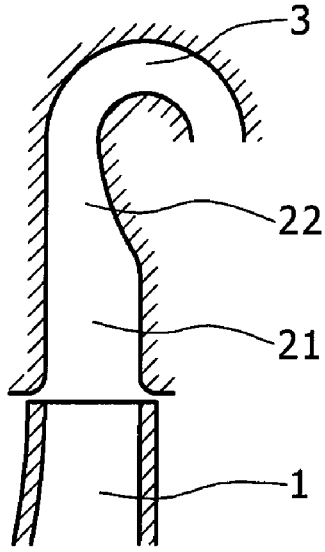
Figure 13:
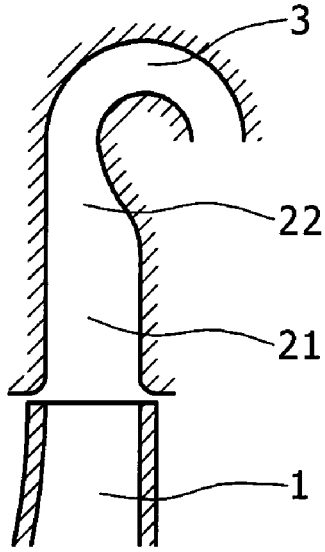
Figure 14:
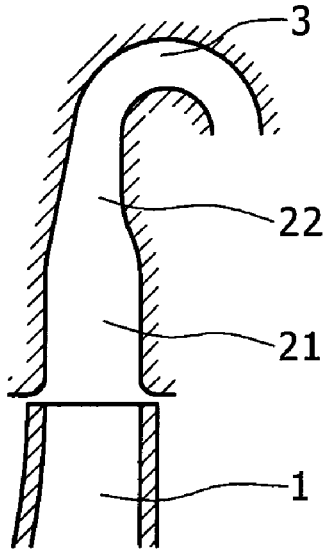
Figure 15:
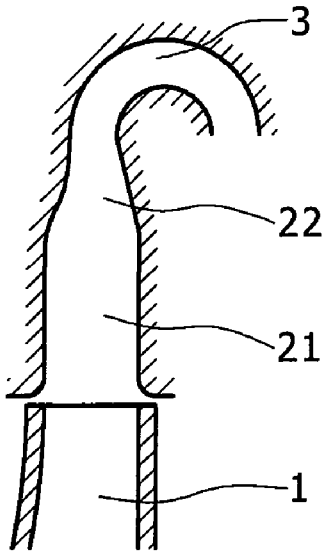

In the tenth embodiment shown in FIG. 11, the inlet of the second vaneless diffuser is smoothly connected to the outlet of the first vaneless diffuser. In the eleventh and twelfth embodiments shown in FIGS. 12 and 13, opposite to the ninth and tenth embodiments shown in FIGS. 10 and 11, the wall surface shape on the hub side is included toward the shroud side. In the thirteenth and fourteenth embodiments shown in FIGS. 14 and 15, the wall surface shapes on the hub side and the shroud side in the second vaneless diffuser are inclined toward each other.

Fifteenth Embodiment

Figure 16:
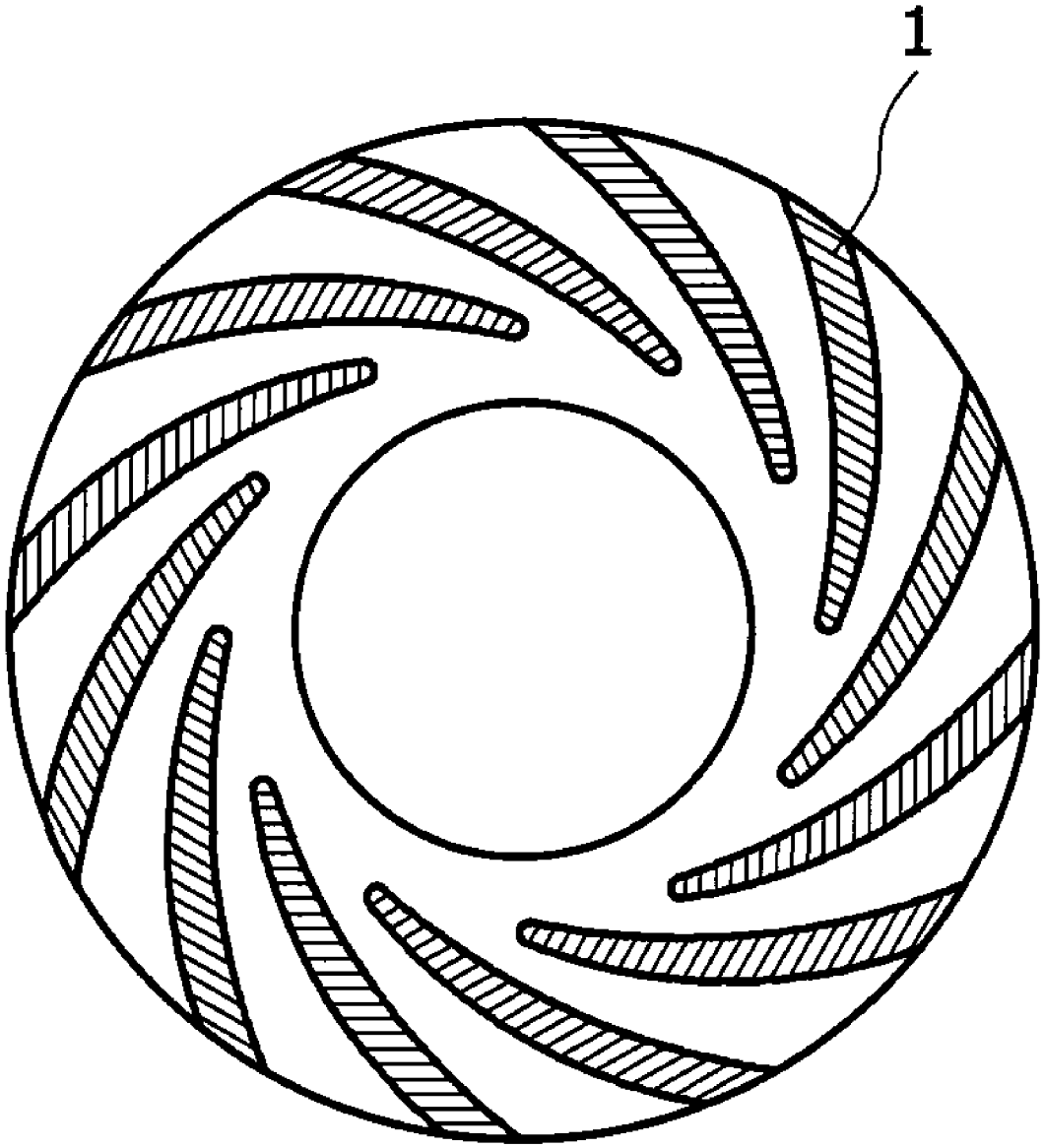
FIG. 16 is a front view of an impeller using wedge-shaped thick blades according to a fifteenth embodiment of the present invention.

As a fifteenth embodiment, in the single-shaft multi-stage centrifugal compressor shown in FIG. 1, the impellers 1 (1A to 1E) in the respective stages are impellers using wedge-shaped thick blades as shown in FIG. 16. The first vaneless diffuser having a constant flow channel height is provided on the downstream side of the impeller, and the second vaneless diffuser in which the flow channel height decreases in the flow direction is provided downstream from the first vaneless diffuser. In a comparatively-low specific speed region, the performance of the impeller using the wedge-shaped thick blades is higher in comparison with a impeller using general thin blades. In the thick blade impeller, as the outlet flow channel height is greater in comparison with a thin blade impeller with the same flow rate, a reverse flow easily occurs even when the flow angle is comparatively wide. Accordingly, a high effect of preventing the rotating stall by the vaneless diffuser can be produced.

What is claimed is:

1. A centrifugal compressor comprising:

a rotating shaft, an impeller attached to the rotating shaft;

at least one vaneless diffuser provided on a downstream side of the impeller;

an inlet flow channel; and a return channel, wherein the at least one vaneless diffuser includes a first vaneless diffuser with a constant flow channel height provided on the downstream side of the impeller, and a second vaneless diffuser in which a flow channel height decreases in a flow direction from an inlet to an outlet, provided on the downstream side of the first vaneless diffuser, wherein an inlet radius ratio $r_m/r_{imp}$ as a ratio between an inlet radius $r_m$ of the second vaneless diffuser and an outlet radius $r_{imp}$ of the impeller becomes smaller in accordance with a decrease in a flow channel height ratio $b_m/r_{imp}$ as a ratio between an inlet flow channel height $b_m$ of the second vaneless diffuser and the outlet radius $r_{imp}$ of the impeller, and wherein the inlet radius ratio rm/rimp of the second vaneless diffuser is given as a function $r_m/r_{imp} \leqq 1.03+3.0 \cdot b_m/r_{imp}$ of the flow channel height ratio $b_m/r_{imp}$ of the second vaneless diffuser.

2. The centrifugal compressor according to claim 1, wherein an outlet flow channel height $b_o$ of the second vaneless diffuser is set to 0.4 to 0.6 times of the inlet flow channel height $b_m$ of the second vaneless diffuser.

3. The centrifugal compressor according to claim 1, wherein the flow channel height ratio $b_m/r_{imp}$ of the second vaneless diffuser is equal to or less than 0.1.

4. The centrifugal compressor according to claim 1, wherein a longitudinal cross-sectional shape of the first and second vaneless diffusers consists of straight lines.

5. The centrifugal compressor according to claim 1, wherein a longitudinal cross-sectional shape of the first and second vaneless diffusers includes a curve.

6. The centrifugal compressor according to claim 1, wherein the impeller has wedge-shaped thick blades.

7. A vaneless diffuser for a centrifugal compressor, the compressor comprising:

a rotating shaft;

an impeller attached to the rotating shaft;

at least one vaneless diffuser provided on the downstream side of the impeller;

an inlet flow channel; and a return channel, wherein the at least one vaneless diffuser includes a first vaneless diffuser with a constant flow channel height, and a second vaneless diffuser, in which a flow channel height decreases in a flow direction from an inlet to an outlet, provided on the downstream side of the first vaneless diffuser, wherein an inlet radius ratio $r_m/r_{imp}$ as a ratio between an inlet radius $r_m$ of the second vaneless diffuser and an outlet radius $r_{imp}$ of the impeller becomes smaller in accordance with a decrease in a flow channel height ratio $b_m/r_{imp}$ as a ratio between an inlet flow channel height $b_m$ of the second vaneless diffuser and the outlet radius $r_{imp}$ of the impeller, and an outlet flow channel height $b_o$ of the second vaneless diffuser is set to 0.4 to 0.6 times the inlet flow channel height $b_m$ of the second vaneless diffuser.

* * * * *